United States Patent [19]

Doyen et al.

[11] 4,353,539

[45] Oct. 12, 1982

[54] PROCESS FOR POSITIONING A SUPPLE PIECE IN SHEET FORM ON A SUPPORT SURFACE AND HANDLING INSTALLATION APPLYING SAID PROCESS

[75] Inventors: Joël Doyen, Ste Savine; Jean P. Raisin, Troyes, both of France

[73] Assignee: Agence Nationale de Valorisation de la Recherche (ANVAR), Neuilly sur Seine, France

[21] Appl. No.: 148,508

[22] Filed: May 9, 1980

[30] Foreign Application Priority Data

May 18, 1979 [FR] France ..... 79 12802

[51] Int. Cl.[3] ..... B65H 5/10; B65H 9/20; B65H 5/13

[52] U.S. Cl. ..... 271/10; 112/121.12; 271/228; 271/268; 271/261

[58] Field of Search ..... 271/228, 227, 18.3, 271/19, 24, 25, 268, 267, 85, 261, 21, 22, 18, 10, 84, 241, 206; 112/121.12, 121.11, 121.15, 2; 198/434

[56] References Cited

U.S. PATENT DOCUMENTS

| | | | |
|---|---|---|---|
| 3,253,824 | 5/1966 | Southwell et al. | 271/19 |
| 3,360,262 | 12/1967 | Kekopoulos et al. | 271/227 |
| 3,747,920 | 7/1973 | Linkus | 271/85 |
| 3,789,781 | 2/1974 | Carson et al. | 112/121.29 |
| 4,157,825 | 6/1979 | Ellenberger et al. | 271/267 X |

*Primary Examiner*—Bruce H. Stoner, Jr.
*Attorney, Agent, or Firm*—Poms, Smith, Lande & Rose

[57] ABSTRACT

The present invention relates to a process for positioning a supple piece in sheet form on a support surface and to a handling installation applying this process, whereby the piece on the storage support is gripped by two so-called gripping points, these points are displaced along parallel paths above the support surface so that one end of the piece trails on this surface, and each of said gripping points is released independently of each other, as soon as the trailing free edge of the piece passes through a respective point of alignment of the support surface. The invention is particularly applied to the automatic supply of a sewing station.

11 Claims, 9 Drawing Figures

PROCESS FOR POSITIONING A SUPPLE PIECE IN SHEET FORM ON A SUPPORT SURFACE AND HANDLING INSTALLATION APPLYING SAID PROCESS

The present invention relates to a process for positioning a supple piece in sheet form, such as a piece of fabric, on a support surface.

The invention also relates to a handling installation for carrying out this process.

It is an object of the invention to propose a process of easy execution, enabling a supple piece in sheet form, removed from a storage support where said supple piece was previously deposited in an appproximate position, to be automatically deposited on a receiving support, in a predetermined position.

This object is attained, according to the invention, in that two so-called points of alignment are defined on the support surface, the piece on the storage support is gripped by at least two so-called gripping points on the piece, spaced apart from each other and preferably located along an edge thereof, these points are displaced along substantially parallel paths extending above the support surface so that at least one end of the piece trails on this surface, and each of said gripping points is released, independently of each other, as soon as a conspicuous line of the piece passes through a respective point of alignment of the support surface, each point of alignment being located substantially at the level of the path of the corresponding gripping point.

This process is advantageously carried out in a handling installation which is characterised, according to the invention, in that it comprises a frame on which are mounted a support for storing at least one supple piece in sheet form, a receiving deivce having a receiving surface for receiving a supple piece, and a gripping and transfer device for seizing at least two points, spaced apart from each other, on a piece located on the support to displace these points above the receiving surface so that one end of said piece trails on this surface and to release each of these points independently of each other as soon as a conspicuous line of the piece passes through a respective, so-called point of alignment of the receiving surface. This conspicuous line is, for example, the free edge of the piece, said free edge defining said trailing end of the piece.

The points of alignment are advantageously fixed with respect to the frame.

The receiving device is advantageously the mobile member of a device for transferring between a first and a second station.

The mobile member of the transfer device is advantageously substantially transparent and the points of alignment are materialised by optical detectors placed beneath said receiving surface.

The gripping and transfer device advantageously comprises means for successively seizing the top piece of the pile, by its so-called gripping end, located opposite the first station of the transfer device, lifting this end by a certain height, displacing this end above the rest of said top piece in the direction of the first station of the transfer device, so as to form on this piece a fold facilitating its detachment from the sub-jacent piece, and for continuing the displacement of said end above the receiving surface of the receiving device until said conspicuous line passes through said points of alignment.

A free space is advantageously made between the support and the transfer device to allow the unfolding of the piece gripped by the gripping and transfer device, by gravity.

The gripping and transfer device advantageously comprises first gripping means for seizing the gripping end of the piece and lifting it by a certain height, and second gripping means for seizing this lifted end and for displacing it until it is straight above the receiving surface of the receiving device.

The installation according to the invention thus makes it possible to transfer and position, one by one, each of a plurality of pieces stacked in approximate positions on the storage support.

This installtion thus finds advantageous application in the automatic supply of a sewing station, such as for example a cording station, stitcher, overcasting machine, etc., with pieces of material whose finish necessitates several passages in a sewing station.

The invention will be more readily understood on reading the following description with reference to the accompanying drawings, in which:

FIG. 1 is a view in perspective of a handling installation according to one embodiment of the invention.

FIGS. 2*a* to 2*d* each show, in vertical section along plane II—II of FIG. 1 and in elevation, a phase of functioning of the installation of FIG. 1.

Figure 1:
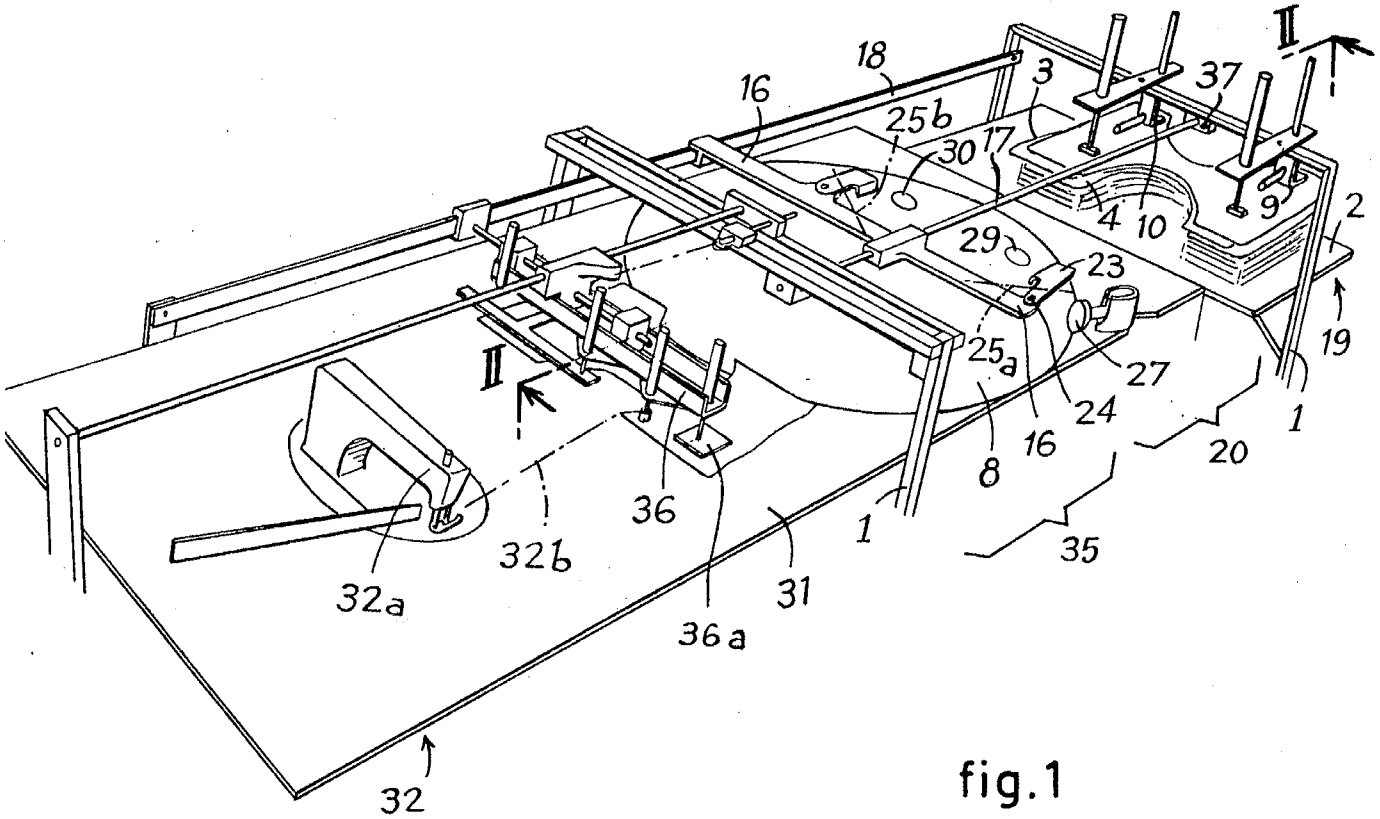
Figure 2A:
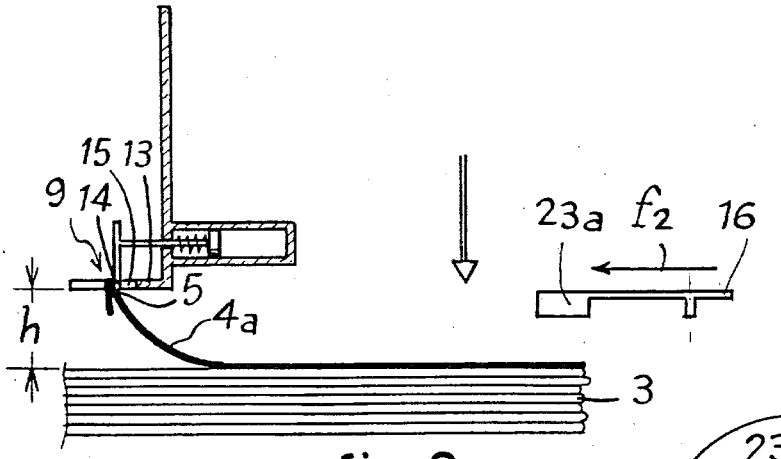
Figure 2B:
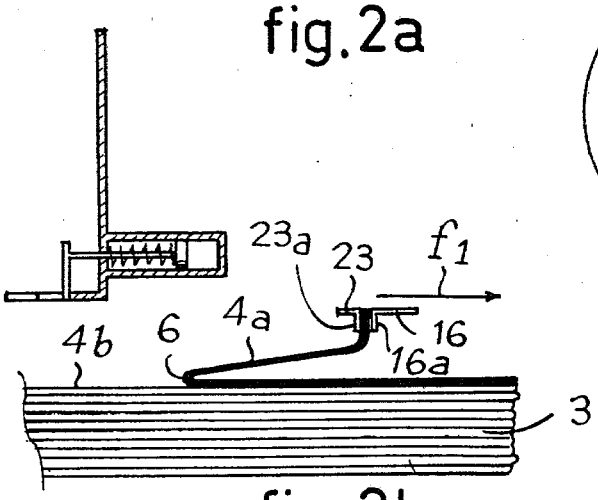
Figure 2D:
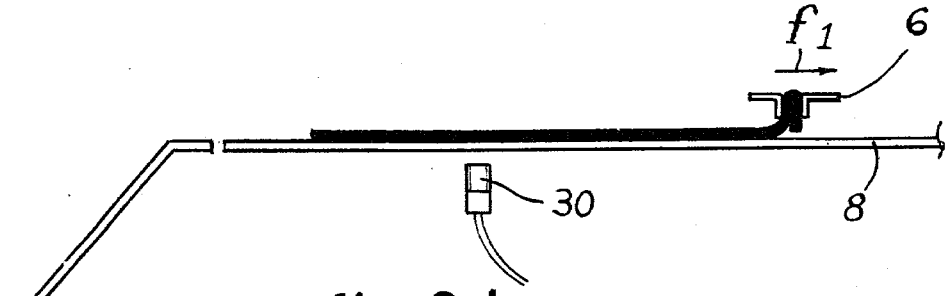
Figure 2C:
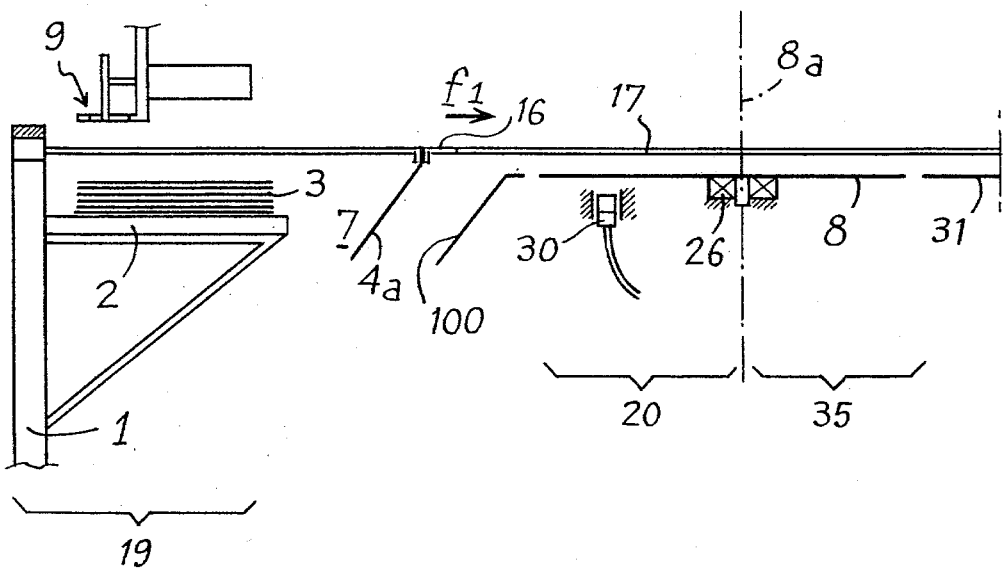

Referring now to the drawings, the handling installation shown in FIG. 1 comprises a frame 1 on which are mounted a flat horizontal support 2 for a stack 3 of pieces of fabric such as pieces of underpants 4, first gripping means for seizing and lifting by a certain height one end 5 of the top piece 4*a* of the stack 3 (FIG. 2*a*), and second gripping means designed to (a) seize said lifted end 5, (b) displace this end horizontally in a direction (arrow $f_1$, FIG. 2*b*) such that this end 5 firstly overhangs the rest of the piece 4*a* so as to facilitate the detachment of this piece from the immediately sub-jacent piece 4*b* due to the formation of a fold 6 of small radius of curvature (FIG. 2*b*);

(c) continue the displacement of this end 5 in the same direction ($f_1$) so that the piece 4*a* unfolds freely in a free space 7 located immediately downstream of the support (FIG. 2*c*); and (d) continue this displacement so that the unfolded piece 4*a* is deposited flat on a horizontal receiving support 8 located downstream of space 7 (FIG. 2*d*).

Figure 3:
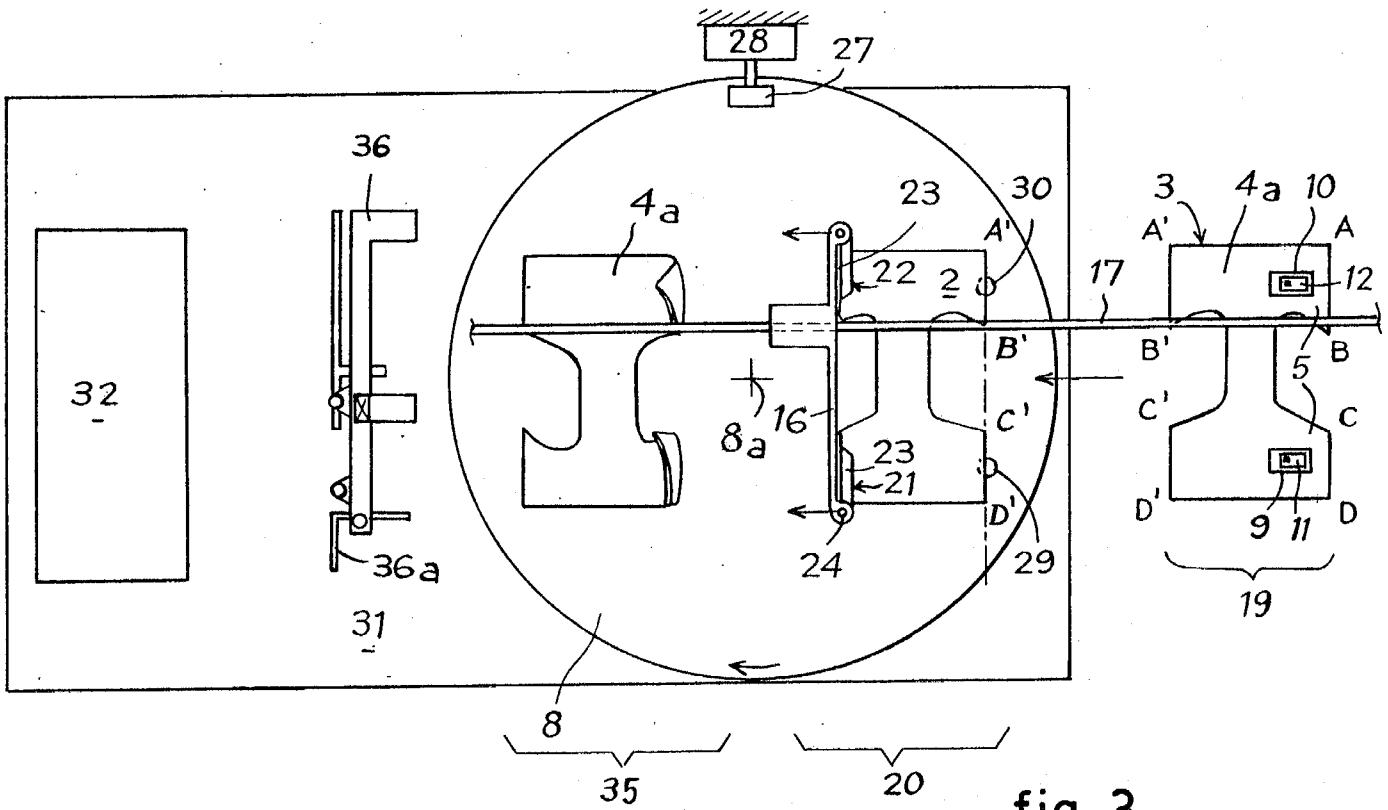
FIG. 3 is a schematic plan view of FIG. 1.

According to the example shown, the first gripping means are of the type described in French Patent Application No. 79 12639 filed by Applicants on May 17, 1979. These means comprise two gripping means 9, and 10 each arranged in order (a) to be applied with a certain pressure on a respective zone 11 and 12 of the end 5 of the top piece 4*a* of the stack 3 (FIG. 3);

(b) to seize this zone 11, 12 by gripping the piece 4*a* between a flat, so-called pressing element 13 of the gripping means 9, 10 and another element 14 in the form of a finger engaged in an opening 15 of said flat element 13 (FIG. 2*a*); and (c) to lift said end 5 of piece 4*a* up to a certain height "h" (FIG. 2*a*).

Figure 4:
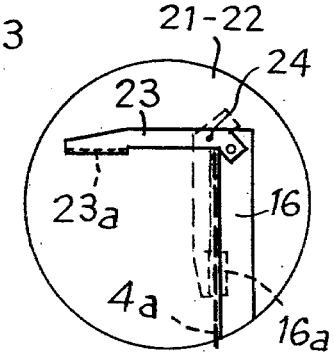
FIG. 4 is a plan view showing in detail a gripping means of the flattening carriage of the installation of FIG. 1.

According to the example shown, the two gripping means comprise a carriage 16 mounted to move horizontally in translation on two horizontal guide rods 17 and 18 parallel to each other, fixed on the frame 1 and extending from a first station 19 where the support 2 of the stack 3 is located up to a second station 20 where the support 8 for receiving the pieces 4 is located. The carriage 16 extends transversely with respect to its direction of displacement so as to be able to overhang the stack 3 of pieces over the whole of its extent transverse with respect to said direction of displacement, when said carriage is located at the first station 19. The carriage 16 is provided with two gripping means 21 and 22 each positioned so as to overhang a respective side edge DD', AA' of the pieces 4 of the stack 3 when said carriage is located at the first station 19. Each of the gripping elements 21, 22 comprises a finger 23 pivoted about a vertical axis 24 on the carriage 16 and a control jack 25*a*, 25*b* (shown schematically in FIG. 1 by a line of axis) interposed between the finger 23 and the body of the carriage 16 to ensure the pivoting of said finger 23 on the carriage 16 between:

(a) an open position as shown in continuous lines in FIGS. 1, 2*a* and 4, for which position the free end of the finger 23 points in the direction from the second (20) to the first station (19), and (b) a closed position as shown in continuous lines in FIGS. 2*b*, 2*c*, 2*d* and 3 and in dashed and dotted lines in FIG. 4, for which position the free end of the finger 23 is turned down towards the centre on the carriage 16, a tongue 23*a* of the finger 23 cooperating with a tongue 16*a* of the body of the carriage 16 to constitute two gripping elements adapted to tighten a side zone of a piece 4 therebetween.

In the example shown, the receiving support 8 is a circular transfer table, mounted on a bearing 26 of the frame 1 to rotate about its vertical axis 8*a* and associated with drive means for driving it in rotation about axis 8*a*. These drive means are constituted by a friction roller 27 applied on the table 8 and driven in rotation from a motor 28 (FIG. 3).

The turnatable 8 is made of a transparent material and two optical detectors 29, 30 are disposed beneath the table 8, each at a fixed point of the frame 1.

According to the example shown, the table 8 is located upstream of a fixed table which is coplanar (31) and which is the table of a cording station 32 shown schematically in FIG. 3, in which station a band is fixed by sewing along the concave edge B'C' of a piece 4.

Figure 5:
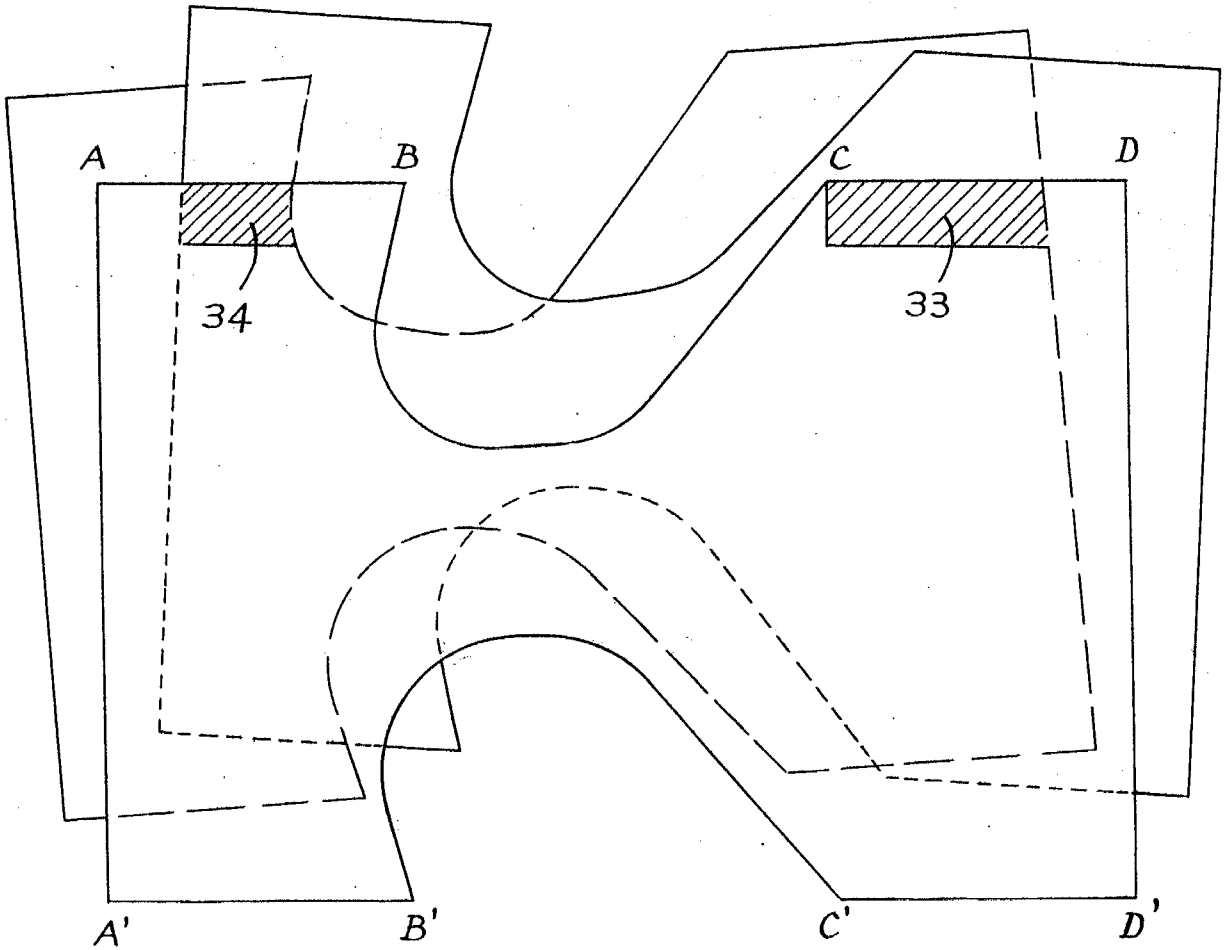
FIG. 5 is a plan view of the stack of pieces to be handled.

To supply the cording station 32, the present installation automatically removes the articles 4 stacked at station 19, one by one. The pieces of underpants 4 are, at station 19, stacked on one another approximately and present variations in position as shown in FIG. 5. In practice, to take all the pieces 4 near the edges AB and CD, it is advantageous to grip them in a zone common to all these articles 4, i.e. at the hatched portions 33, 34 of FIG. 5. Taking into account these gripping zones 33, 34 of the articles 4, imposed by the imprecision of the stack 3, it is preferable in practice not to cord (at station 32) the edge BC which is deformed during its seizure by the gripping means 9, 10 and which cannot easily be flattened subsequently. It is one of the reasons for which cording is effected on the opposite edge A'B'C'D' which may be maintained flat during the handling of the pieces 4 in the installation. The two gripping means 9 and 10 are applied on the stack 3, take and detach the piece 4 thereof. The two gripping means 9 and 10 rise, detaching the piece 4*a* from the stack 3 and lifting the end 5 of this piece 4*a* by a certain height "h".

The carriage 16 provided with gripping means 21, 22 makes it possible to take the article 4*a* removed by the first gripping elements 9, 10, to turn this article over and deposit it flat on the turn-table 8. FIG. 3 shows that the gripping means 9, 10 seize the pieces 4 at edge ABCD; after the article 4 has been turned over by the flattening carriage 16, the edge which will in fact be worked on the cording station will be edge A', B', C', D'.

Furthermore, it should be noted that it is preferable to turn the piece 4*a* of the stack over on itself to avoid the displacement of the piece 4*b* during detachment (FIG. 2*b*). When the piece 4*a* is placed flat on the table 8, the edge A', B', C', D' is correctly unfolded and deposited flat whilst edge ABCD may still be folded after it has been deposited on the turn-table.

FIG. 2*a* shows the flattening carriage 16 advancing (arrow $f_2$) towards the article 4*a* held in the gripping means 9, 10.

FIG. 2*b* shows the phase of detachment by turning over the piece 4*a* which is separated from the other pieces 4 of the stack 3 without displacing these latter due to the displacement of the carriage 16 in the opposite direction (arrow $f_1$).

During the advance movement of the flattening carriage 16 (arrow $f_1$, FIG. 2*c*), the article 4*a* leaves the storage stack 3 and unfolds by gravity before being deposited flat on the turn-table 8.

FIG. 2*d* shows the deposit of the piece 4*a* flat on the turn-table 8.

The two detectors 29, 30 placed beneath the turntable 8 each trigger off the opening of the corresponding gripping means 21, 22, upon passage of the side of edge D'C' and B'A' respectively, this enabling the article 4*a* to be released in a relatively precise position on the table 8 and its starting position issuing from the stack 3 to be at least partially corrected. This principle makes it possible to orient the edge A'B'C'D' in a predetermined orientation with respect to the fixed sewing line 32*b* (FIG. 1) of the cording station 32. This orientation constitutes a stage necessary for the correct presentation of the edge B'C' of the sewing machine of said station.

As soon as the two gripping means 21, 22 open, the carriage 16 stops and returns towards the following article 4*b* which is being gripped. At the same time, the turn-table 8 makes a rotation through 180° to transfer the piece 4*a* to a following station 35 where the edge A'B'C'D' is placed beneath the shoes 36*a* in high position of a flat transfer carriage 36 displaceable between station 35 and station 32.

The role of the table 8 is to ensure the relay between the second gripping means 16, 21, 22 and the carriage 36 which transfers the article 4*a* to the sewing machine 32*a* of station 32. It receives the pieces of underpants 4 coming from the approximate stack 3. These pieces 4 are deposited one after the other in the part of table 8 located at station 20 whilst the preceding article 4 is flat on the other half of table 8 above which is located the end of return stroke position of the carriage 36. The shoes 36*a* of the carriage 36 are applied on the piece 4*a* of the station 35 and this piece is taken by carriage 36 towards the sewing machine of station 32.

Figure 6:
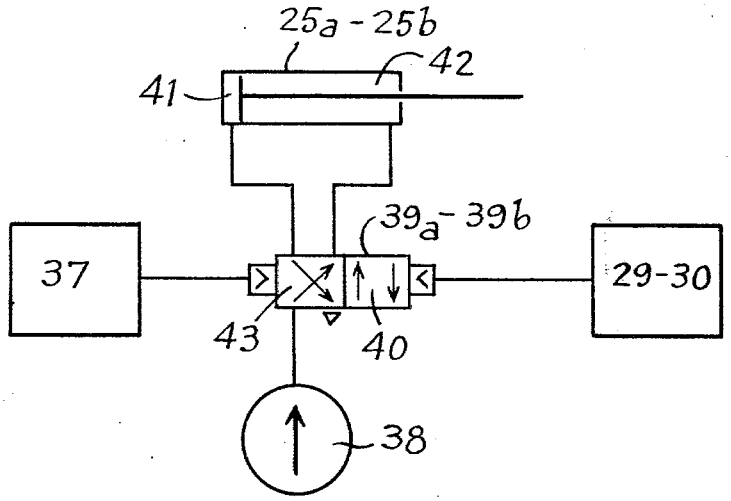
FIG. 6 is a diagram of the control circuit of each gripping means of the flattening carriage according to an embodiment of the invention.

FIG. 6 shows the diagram of the circuit for controlling the gripping means 21, 22 of the flattening carriage 16. The pneumatic jack 25*a*, 25*b* associated with each gripping means 21, 22 is controlled from (a) a signal which is emitted by the corresponding detector 29, 30 when the corresponding so-called reference edge C'D', A'B' passes over the latter, and (b) a singal emitted by an end of stroke pick-up 37 when the carriage 16 is in its end of stroke position at station 19. As shown in FIG. 6, each jack 25*a*, 26*b* is supplied with compressed air from a source 38 via a respective distributor of the four-way, two-position type (39*a*, 39*b*). In this way, when a reference edge, for example edge C'D', passes at right angles to detector 29, the gripping means 21 is opened by placing the jack 25*a* in extended position due to the switch of the distributor 39*a* onto its position 40 placing the chamber 41 of the jack 25*a* under pressure and connecting the other chamber 42 of this jack 25*a* to atmosphere. The closure of the gripping means 21 is obtained by placing the jack 25*a* in contracted position, this positioning being effected by switching the distributor 39*a* onto its position 43 for which the chamber 42 is under pressure and the chamber 41 connected to atmosphere.

The other gripping means 22 is controlled according to the same process, substituting detector 30, jack 25*b* and distributor 39*b* for detector 29, jack 25*a* and distributor 39*a*, respectively, in the description of functioning given hereinabove.

It is advantageous to place a fixed guiding wall 100, inclined downwardly in the direction of the station 19, between the free space 7 and the table 8, the upper end of which wall is connected to the table 8.

What is claimed is:

1. A process for positioning in an aligned position a piece of sheet material on a receiving station taken from a storage surface where the piece had been in an unaligned position comprising the steps of:

gripping the piece at at least two, spaced apart, gripping points, displacing the gripping points along substantially parallel paths extending above the support surface so that at least one edge of the piece trails on the support surface, detecting the passage of selected portions of the piece at spaced locations on the support surface, each detecting location being operatively associated with a corresponding one of the gripping points, and releasing each of the gripping points independently of each other when the selected portion of the piece is detected at each corresponding location.

2. A handling apparatus for positioning a sheet of material on a receiving station comprising;

a frame having a storage area for storing unaligned sheets of material, the receiving station being mounted on the frame and spaced apart from the storage area, and transfer means on the frame for transporting the sheet of material from the storage area to the receiving station, the improvement comprising the provision of:

the transfer means comprising at least two, spaced-apart gripping means for gripping the sheet and for releasing the sheet independently of each other and transport means for moving the gripping means to move the sheet of material from the storage area to the receiving station when the gripping means is gripping a sheet;

at least two detecting means on the frame at the receiving station for detecting the passage of a particular portion of the sheet over each detecting means each detecting means being operatively associated with a corresponding one of the gripping means, control means between the gripping means and the detecting means for causing each of the gripping means independently to release the sheet when the corresponding detecting means detects the passage of the predetermined portion of the sheet.

3. The apparatus of claim 2 comprising a mobile member mounted on the receiving station, and drive means associated with the receiving station for displacing said mobile member between a first and a second station.

4. The apparatus of claim 3, wherein the mobile member is a rotating table.

5. The apparatus of claim 2, wherein the detecting means are fixed with respect to the frame.

6. The apparatus of claim 2, wherein the receiving station comprises a substantially transparent receiving wall, and the detecting means comprises optical detectors placed beneath said receiving wall.

7. The process of claim 1 further comprising the step of mounting the piece of material in a stack of such pieces disposed on the storage surface, successively seizing the top piece of the stack at a first side near the edge of the piece located opposite the receiving station, lifting the first side a certain height, displacing the first side above the rest of pieces in the stack in the direction of the receiving station, folding the first side of the piece over a second side of the piece opposite the first side while the second side remains in contact with the subjacent piece, and continuing the displacement of the first side above the receiving station wherein the step of detecting the selected portion of the piece comprises the step of detecting the edge opposite the first side of the piece.

8. The apparatus of claim 2, wherein the storage area and the receiving station are spaced apart a distance sufficient to allow the unfolding of the piece gripped by the transfer means by gravity.

9. The apparatus of claim 2, wherein the transport means comprises a vertical transport means for lifting the piece by a certain height before the gripping means grips the sheet and a horizontal transport member for horizontally displacing the sheet independently of the vertical transport member to the receiving station.

10. The apparatus of claim 2 wherein the gripping means are positioned to grip a first side of the sheet on the other side of the sheet opposite the receiving station, the transfer means having means for raising the first side of the sheet a certain distance above the subjacent sheets, the transfer means having means for horizontally displacing the sheet toward the receiving station such that the sheet folds over the subjacent sheet and such that the first side of the sheet leads as the transfer means moves toward the receiving station, whereby the passage of the edge of the sheet opposite the first side thereof is detected by the detecting means.

11. The apparatus of claim 2 wherein the control means operatively connects each gripping means with one of the detecting means, the control means causing one gripping means to release the sheet when the detecting means associated with the gripping means detects the passage of the predetermined portion of the sheet.

* * * * *